United States Patent [19]

Wardy et al.

[11] Patent Number: 4,975,560

[45] Date of Patent: Dec. 4, 1990

[54] APPARATUS FOR POWERING THE CORROSION PROTECTION SYSTEM IN AN ELECTRIC WATER HEATER

[75] Inventors: Daher T. Wardy, Milwaukee; Timothy H. Houle, Wauwatosa; Calvin O. Huber; James L. Chevalier, both of Meguon, all of Wis.

[73] Assignee: A.O. Smith Corporation, Milwaukee, Wis.

[21] Appl. No.: 403,704

[22] Filed: Sep. 6, 1989

[51] Int. Cl.[5] ..... F24H 1/00

[52] U.S. Cl. ..... 219/322; 204/196; 204/197

[58] Field of Search ..... 219/322, 363, 481, 331, 219/318, 327; 204/196, 197

[56] References Cited

U.S. PATENT DOCUMENTS

| | | | |
|---|---|---|---|
| 3,132,082 | 5/1964 | Overmyer | 219/322 |
| 3,176,115 | 5/1964 | Balis | 219/322 |
| 3,425,921 | 2/1969 | Sudrabin | 204/196 |
| 4,255,242 | 3/1981 | Freeman | 204/196 |
| 4,255,647 | 3/1981 | Rickert et al. | 219/322 |
| 4,848,616 | 7/1989 | Nozaki | 219/322 |

*Primary Examiner*—Bruce A. Reynolds
*Assistant Examiner*—Tu Hoang
*Attorney, Agent, or Firm*—Andrus, Sceales, Starke & Sawall

[57] ABSTRACT

A common source of DC potential is utilized to simultaneously provide power to the protective anode in an electrically heated hot water heater and to the circuit used to bias the heating element jacket to reduce the current load the jacket would otherwise impose on the protective anode. By utilizing a common DC power source, the desired voltage relationship between the protective anode, the positively biased heating element jacket and negatively biased tank wall may be maintained, regardless of changes in the supply. The need for a second separate power supply is obviated and overall construction of the system substantially simplified. The DC power source may comprise a battery or rectified AC current from the power to the heating element.

5 Claims, 1 Drawing Sheet

APPARATUS FOR POWERING THE CORROSION PROTECTION SYSTEM IN AN ELECTRIC WATER HEATER

BACKGROUND OF THE INVENTION

The present invention relates to an apparatus for powering a sacrificial protective anode in a water storage tank and for reducing the rate of loss of the anode as a result of undesirable cathodic reactions and, more particularly, to an apparatus for providing operating power to a powered protective anode and to a circuit for reducing the protective anode current as a result of the cathodic effect of the metal-jacketed heating in an electric water heater.

A typical water heater includes a storage tank made of ferrous metal and lined internally with a glass-like porcelain enamel to protect the metal from corrosion. Nevertheless, the protective lining may have imperfections or, of necessity, not entirely cover the ferrous metal interior, such that an electrolytic corrosion cell may be established as a result of dissolved solids in the stored water leading to corrosion of the exposed ferrous metal and substantial reduced service life of the water heater. The water in the tank may be heated by gas or electric power and it is well known that uninhibited corrosion is substantially enhanced in the presence of hot water.

It is also well known in the art to utilize a sacrificial anode within the tank to protect against corrosion of the ferrous metal tank interior. The anode is maintained negative with respect to the tank, either by providing a passive anode constructed of a metal that is electrochemically more negative than the tank metal or by providing a source of electrical potential to establish a positive voltage differential between the anode and the tank.

In an electric water heater, an electric heating element is attached to the tank wall and extends into the tank to provide direct heating of the water. The heating element typically includes an internal high resistance heating element wire surrounded by a suitable insulating material and enclosed in a metal jacket such that the jacket is completely insulated from the internal heating element. Power for the heating element is typically supplied from a conventional 110 or 220 volt AC source. When the exterior metal jacket of the heating element is immersed in the water in the tank, it imposes an electrical load on the protective anode in the same manner as the exposed ferrous metal interior of the tank. As a result, the protective anode current is increased and the anode is subject to more rapid dissolution. Therefore, the life of the anode and thus the water heater are substantially shortened. In a typical electric water heater, less than half the protective anode current is needed to protect the tank interior with the remaining current resulting from the additional load imposed by the heating element jacket. However, the heating element jacket typically comprises or is plated with a metal more electropositive than the tank metal and thus does not require the same level of cathodic protection. In addition, heating elements are relatively inexpensive and easy to replace. In addition to the large current draw imposed on the protective anode by the heating element jacket, the heating element also creates a "shadowing" effect on any exposed interior portions of the tank in the vicinity of the heating element. As a result, anode current which might otherwise protect these areas of the tank flows instead to the heating element jacket and leaves the metal tank wall portions in this area with inadequate protection.

It would be most desirable, therefore, to reduce the electrical load which the heating element jacket imposes on the protective anode in an electric hot water heater. One way would be to simply electrically insulate the heating element jacket from the tank. However, the metal tank is typically grounded and, for safety reasons, a conductive path must be provided between the heating element jacket and the tank to provide a shunt for an overvoltage condition, such as would occur if damage to the heating element resulted in a short between the interior element wire and the metal jacket. Another solution to the problem would be to provide a resistance connection between the heating element jacket and the tank wall to reduce the anode current. However, to effectively reduce the anode current draw, the resistance would be too great to provide an adequate ground path in the event of an overload condition. It would also be possible to establish an impressed voltage differential between the heating element jacket and the tank wall, with the former maintained positive with respect to the latter. However, with the heating element jacket otherwise electrically insulated from the tank to allow maintenance of the potential difference, a conductive path for an overvoltage condition would not be available.

In a co-pending and commonly owned patent application entitled "Method and Apparatus for Reducing the Current Drain on the Sacrificial Anode in a Water Heater", there is described a system for applying a positive potential bias to the heating element jacket to reduce its current drain on the protective anode and simultaneously providing a low resistance current path to shunt a hazardous overvoltage current directly to ground. An electric hot water heater utilizing an electrically powered protective anode also requires a DC power source to provide the needed positive voltage bias to the anode.

SUMMARY OF THE INVENTION

In accordance with the present invention, a single power supply is utilized to provide the operating current for both the powered protective anode and the heating element jacket bias circuit in an electric water heater. The electric heating element or elements are mounted in the tank such that the outer metal jacket is electrically insulated from the tank wall. A single source of direct current potential is attached to a circuit to simultaneously apply a potential between the protective anode and the tank and between the jacket and the tank such that the anode and the jacket are maintained positive with respect to the tank. The circuit for simultaneously applying the two potentials preferably includes the protective circuit described and claimed in the above identified copending application, including the potentiometric control for the metal jacket bias potential. The common DC source may comprise a battery or rectified AC current from the power supply to the heating element.

DETAILED DESCRIPTION OF THE PREFERRED EMBODIMENT

Figure 1:
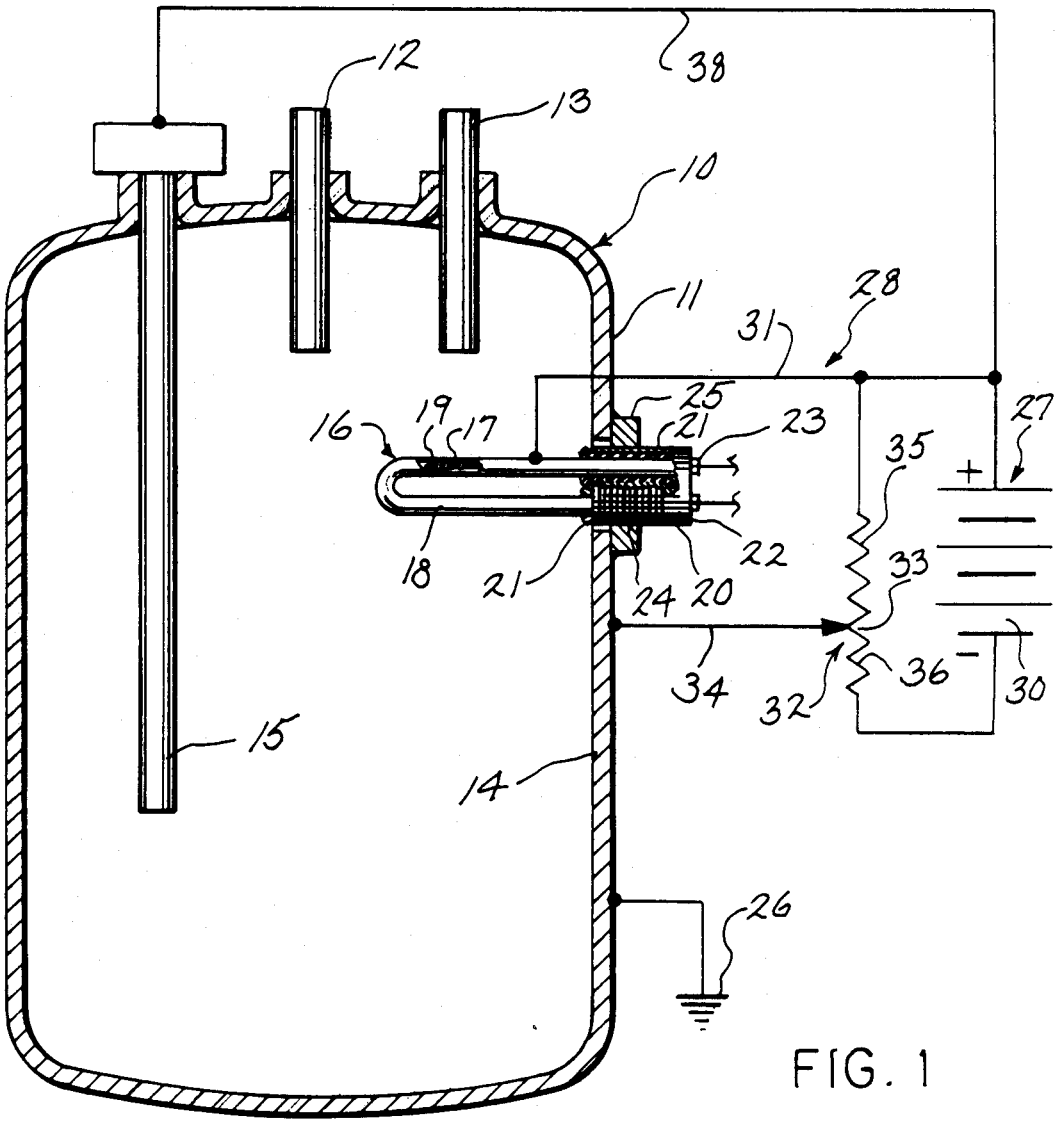
FIG. 1 is a generally schematic representation of an electrically heated water heater including the common power source for powering the protective anode and the anode protection circuit used therewith.

Referring first to FIG. 1, an electric water heater 10 includes a tank 11 made of a ferrous metal, i.e. steel, in which water is stored and heated. The tank includes a cold water inlet 12 and heated water outlet 13, both of a conventional construction. To provide corrosion protection to the interior of the tank, a glass or ceramic lining 14 covers substantially the entire interior of the tank. However, as is well known in the art, minute cracks or other imperfections may develop in the lining 14 or certain portions of the metal tank may not be covered by the lining 14, such that the metal is exposed to the water in the tank. As a result of the usual dissolved minerals and other solids in the water, electrolytic corrosion of the exposed tank will occur absent appropriate protection.

A protective anode 15 is mounted on and extends into the interior of the tank 11 to provide corrosion protection in a known manner. The anode 15 may be of a passive type, as shown, wherein it is constructed of a metal more electronegative than the tank metal to establish an electrochemical couple with the anode 15 acting as a sacrificial electrode to protect the interior tank wall. Alternately, the anode 15 could be externally powered to provide a positive potential difference between the anode and the tank wall without regard to the type of metal from which the anode is constructed. In either case, oxidative dissolution of the anode over time protects the exposed interior metal portions of the tank.

In the electric water heater 10, an electric heating element 16 is mounted in the wall of the tank 11 and extends into the tank interior to contact and heat the water stored therein. In accordance with conventional construction, the heating element 16 includes a high resistance element wire 17 disposed within a U-shaped metal jacket 18 and insulated therefrom by an interior layer of a granular refractory material 19, such as magnesium oxide. The opposite ends of the heating element wire 17 are typically attached to a source of alternating current at 220 or 110 volts. The heating element jacket 18 is typically made of copper and may additionally be tin or zinc plated.

The outer end of the heating element 16 includes a mounting plug 20 for supporting the heating element jacket and attaching the heating element to the tank wall 11. The legs of the heating element jacket extend through the mounting plug 20 and are electrically insulated from the conductive metal plug 20 by insulating sleeves 21. The ends of the heating element wire 17 also extend through the mounting plug to an insulating terminal mount 22 on the outside thereof for connection to a pair of terminals 23 from the AC power source. The mounting plug 20 is provided with exterior threads 24 for attachment to an internally threaded spud or mounting ring 25 which is welded or otherwise attached directly to the tank wall 11. It should be pointed out that, in conventional construction, the insulating sleeves 21 between the heating element jacket 18 and the mounting plug 20 are eliminated, such that there is a direct conductive connection between the jacket and the tank wall. In addition, the tank wall is typically grounded, as at 26. Should damage to or a defect in the heating element result in the wire 17 coming in direct contact with the jacket 18, the prior art construction allows the high voltage current imposed on the heating element jacket to be shunted directly to ground via the conductive connection to the tank wall.

The exposed metal jacket 18 which extends into the water in the tank 11 provides a substantial bare metal surface area which, if conductively connected to the tank, induces a substantially higher current in the protective anode 15 resulting in more rapid dissolution thereof. As previously indicated, merely insulating the element jacket 18 from the tank wall, as with the insulating sleeves 21, would substantially reduce or eliminate the current drain by the heating element on the anode. However, the conductive path between the heating element and ground in the event of an overvoltage condition would be lost. In accordance with the invention claimed in the previously identified co-pending application, a source of controlled DC potential 27 is operatively attached to the heating element jacket and the tank wall via protective circuit 28 to simultaneously provide both an imposed positive potential on the heating element jacket 18 and an overvoltage current path between the jacket and the tank wall. The combined effect is to eliminate or substantially limit the unnecessary current drain by the heating element on the sacrificial anode 15 and protect against the potential electrical hazard resulting from a short circuit between the heating element wire 17 and the jacket 18. The DC power supply 27 may comprise a conventional 6 volt battery 30, the positive terminal of which is connected directly to the heating element jacket 18 via a jacket lead 31. The remainder of the circuit 28 comprises a potentiometer 32 including a variable resistance element 33 having a variable contact 34 connected directly to the tank wall 11. The first fixed leg 35 of the variable resistance 33 is connected to the positive lead between the battery terminal and the element jacket. The second fixed leg 36 of the variable resistor is connected to the negative terminal lead of the battery 30. The battery 30 causes a voltage potential to be impressed between the heating element jacket and the tank wall through the water in the tank. The heating element jacket is maintained positive as a result of its direct connection to the positive terminal of the battery 30 and the value of the potential difference will depend upon the position of the variable contact 34 and the conductivity of the water in the tank.

The indicated potential difference is adequate to effectively eliminate the excessive current drain by the heating element jacket on the anode 15. However, should an overvoltage condition occur in the heating element jacket, a relatively low resistance current path to ground 26 is provided via the first leg 35 of the variable resistance, the variable contact 34 and the tank wall 11.

It is well known that the use of a powered anode 15, rather than a passive anode which relies only on relative electrochemical potential differences between the anode and tank metals, provides enhanced protection as well as the ability to better control anode current. Nevertheless, a powered protective anode is subject to the same current drain and shadowing effect caused by the heating element jacket 18 as previously described. Furthermore, the powered anode 15 obviously requires a DC power source to create the needed potential difference between the anode and the tank wall 11. In accordance with the present invention, the same DC power source 27 used to drive the protective circuit 28 and bias the heating element jacket 18 is used to power the anode 15. Thus, an anode lead 38 connects the positive terminal of the DC power source 27 to the anode 15, thereby establishing the protective potential difference between the anode and the tank wall 11. Because there is no potential high overvoltage hazard with the anode (as there is with the heating element 16), there is no need to provide a protective shunt path between the anode and ground.

However, the potentiometric control used in the jacket bias circuit 28 retains the same voltage relationship between the anode 15 and the jacket 18, regardless of a change in the power supply. Additionally, the combined system of the present invention completely eliminates the need for a second separate DC power source. This makes the entire system much simpler and less expensive.

Figure 2:
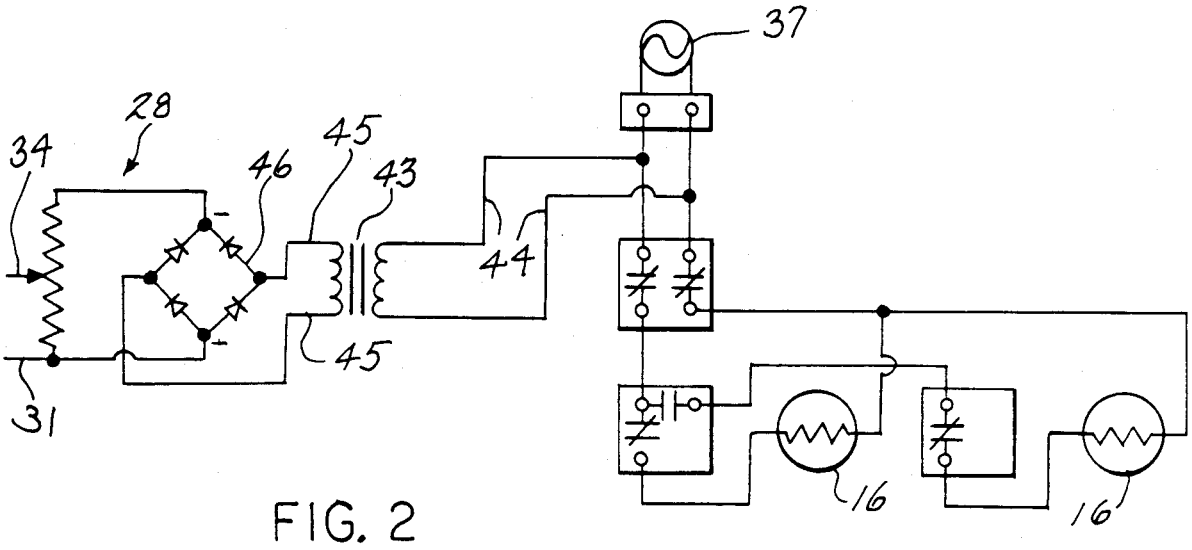
FIG. 2 is a schematic representation of an alternate power source for the protective anode and anode protection circuit.

Referring to FIG. 2, in lieu of a battery 30, the common DC source 27 may be obtained from the AC power source 37 used to heat the heating element 16. Thus, the leads from an AC power source 37 may be tapped with a pair of primary leads 44 to a transformer 43 to appropriately step the voltage down to the required level. The secondary leads 45 may be attached to a conventional four diode bridge 46, resulting in DC current at the appropriate voltage.

Various modes of carrying out the present invention are contemplated as being within the scope of the following claims particularly pointing out and distinctly claiming the subject matter which is regarded as the invention.

We claim:

1. In an electrically heated water supply including a metal tank for heating and storing water, a protective anode within the tank to reduce electrolytic corrosion of exposed interior portions of the tank wall, and an electric heating element enclosed in a metal jacket mounted in the tank wall and extending into the tank, an apparatus for powering the protective anode and for reducing the anode current caused by the cathodic effect of the heating element jacket comprising:

means for mounting the heating element in the tank wall to electrically insulate the metal jacket from the tank wall;

a source of controlled direct current potential; and, circuit means for simultaneously applying a potential from the source between the protective anode and the tank and between the jacket and the tank such that the protective anode and the jacket are maintained positive with respect to the tank.

2. The apparatus as set forth in claim 1 including means for varying the potential applied between the jacket and the tank.

3. The apparatus as set forth in claim 2 wherein said means for varying the potential comprises a potentiometer.

4. The apparatus as set forth in claim 1 wherein the direct current source comprises a battery.

5. The apparatus as set forth in claim 1 wherein the direct current source comprises a rectified alternating current supply.

* * * * *